United States Patent [19]

Larkworthy et al.

[11] 4,104,964

[45] Aug. 8, 1978

[54] APPARATUS FOR PACKING AIRCRAFT ESCAPE DEVICES

[75] Inventors: Peter J. Larkworthy, Seattle; James A. Rose, Bothell; Anthony J. Martin, Spokane, all of Wash.

[73] Assignee: The Boeing Company, Seattle, Wash.

[21] Appl. No.: 784,831

[22] Filed: Apr. 5, 1977

[51] Int. Cl.[2] ..... B30B 7/04; B65B 63/02

[52] U.S. Cl. ..... 100/232; 53/124 R; 53/124 A

[58] Field of Search ..... 100/232; 53/124 R, 124 A

[56] References Cited

U.S. PATENT DOCUMENTS

| | | | |
|---|---|---|---|
| 3,318,234 | 5/1967 | Robertson et al. | 100/232 |
| 3,429,531 | 2/1969 | Sepp | 53/124 R X |

*Primary Examiner*—Travis S. McGehee

*Attorney, Agent, or Firm*—Christensen, O'Connor, Johnson & Kindness

[57] ABSTRACT

A packing fixture to facilitate the shaping and contouring of a slide pack containing an inflatable aircraft escape slide or combination escape slide/lift raft is disclosed. The packing fixture includes a base plate configured for receiving a partially formed slide pack with the slide pack being held in place on the base plate by brace bars that are hinged to the base plate and securably clamped against oppositely disposed side surfaces of the slide pack by jackscrews. A top pan, positionable over the slide pack, compresses the slide pack as straps that encompass the slide pack and top pan are tightened within strap tighteners that interconnect the straps and base plate. The contour of the slide pack end and side surfaces is selectively formed by a forming bar having a pressure pad that is forced against selected regions of the slide pack when one end of the forming bar is engaged with the base plate and the other end of the forming bar is forced inwardly toward the slide pack. As the slide pack is compressed by the top pan and further shaped by use of the forming bar, lacing, which joins the slide pack together and maintains the slide pack in a compressed state, is tightened until the slide pack is of a desired final size and contour.

15 Claims, 9 Drawing Figures

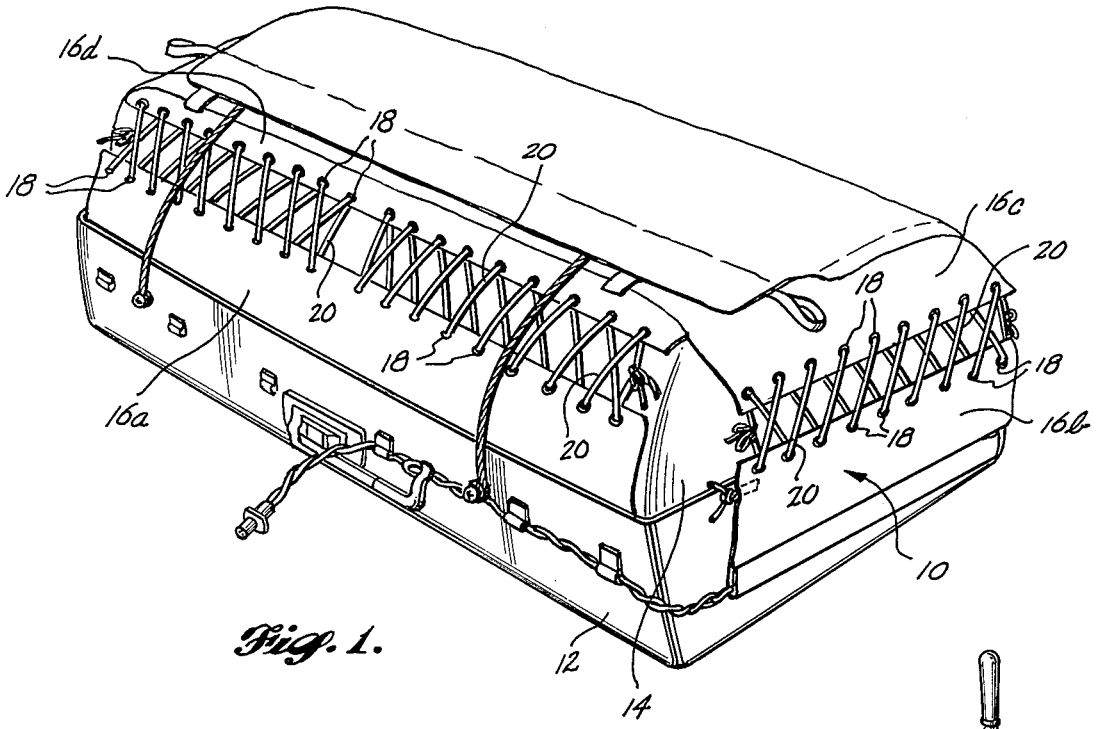
Fig. 1.
Fig. 2.
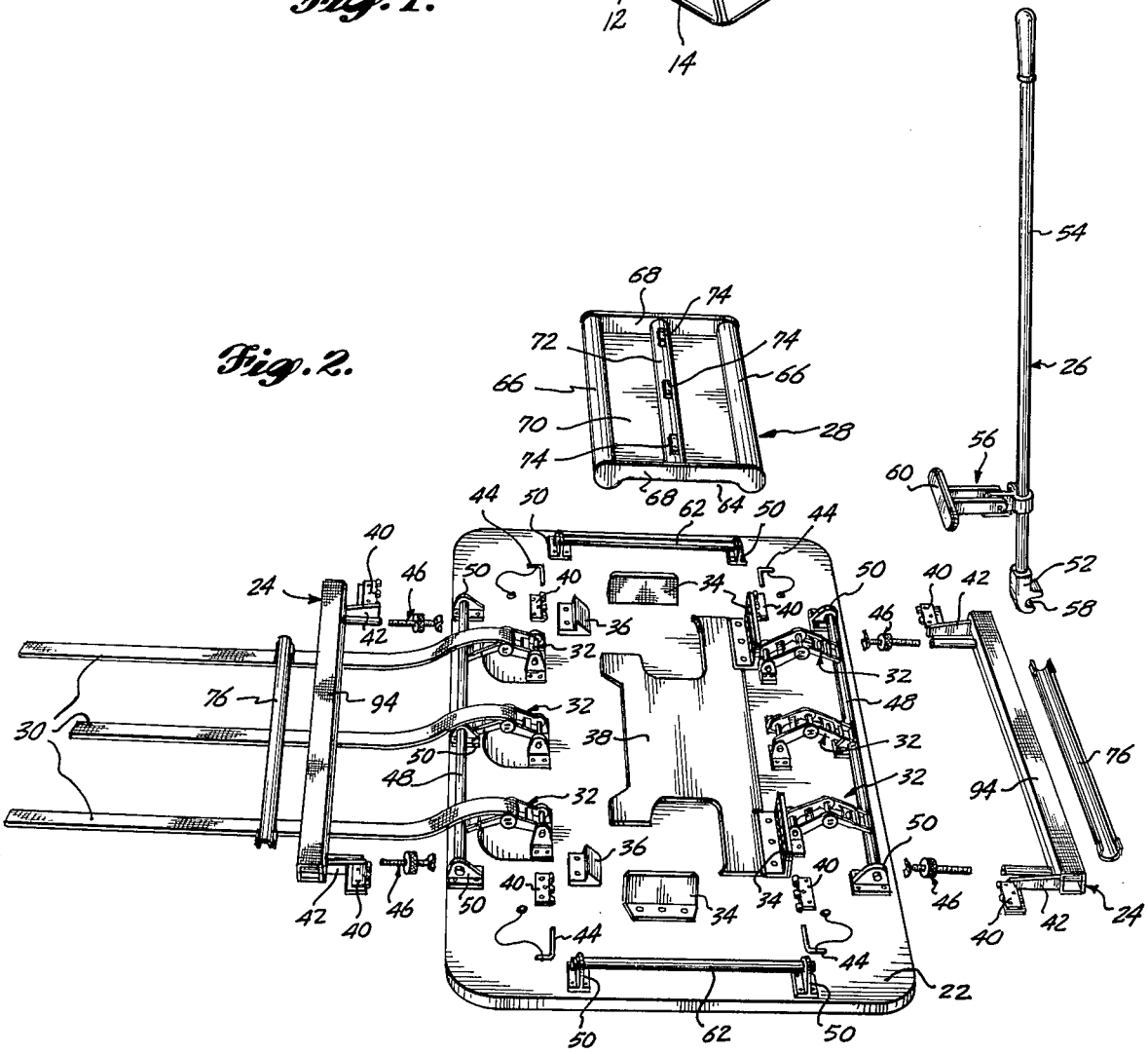

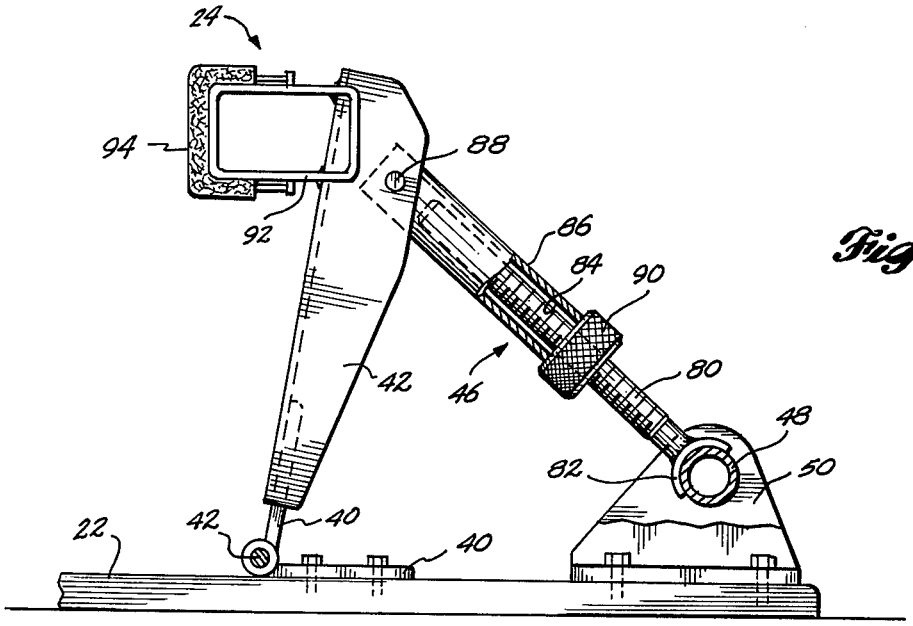
Fig. 4.
Fig. 5.
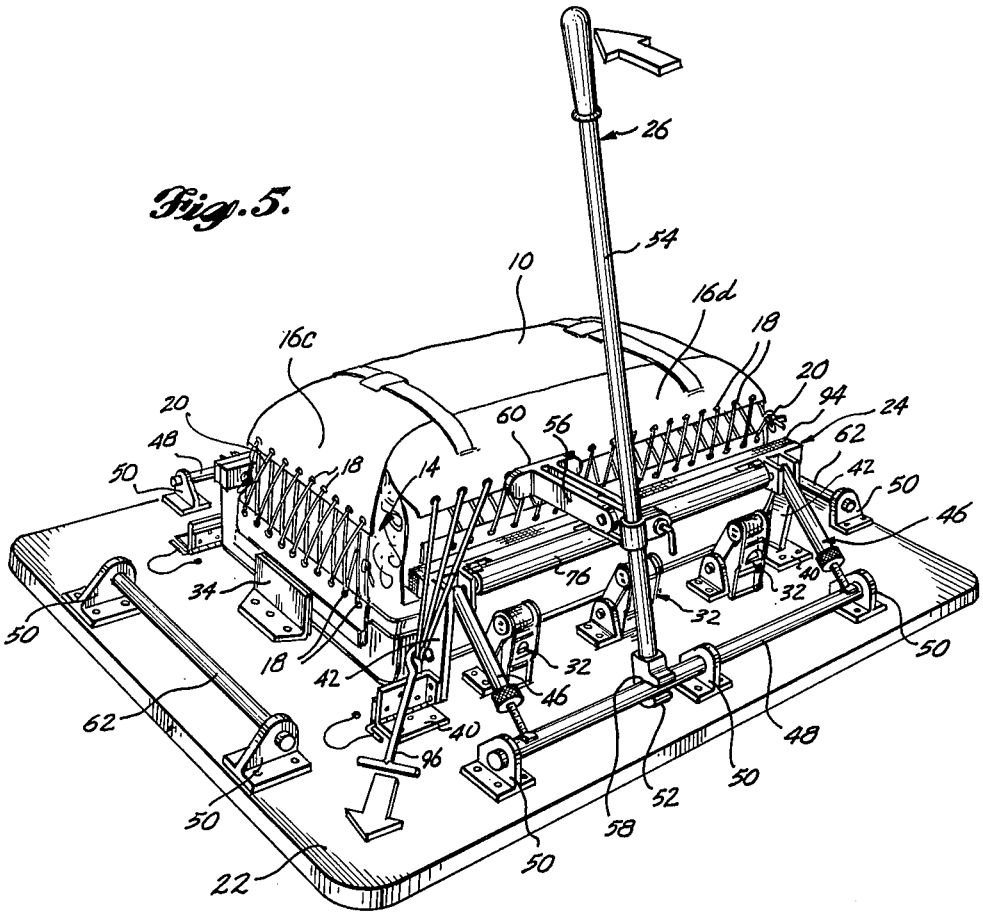

APPARATUS FOR PACKING AIRCRAFT ESCAPE DEVICES

BACKGROUND OF THE INVENTION

This invention relates to inflatable aircraft escape devices. More particularly, this invention relates to a fixture for forming an inflatable aircraft escape slide or combination escape slide/life raft into a compact package of specific dimension and contour.

Inflatable escape slides are installed in virtually all large passenger carrying aircraft to provide rapid evacuation of the passengers and crew during ground emergencies. Such escape slides generally include at least one inflatable member that is deployed between the sill region of an elevated egress door and the surface of the ground or water. The upper surface of the inflatable member is configured to provide a sliding surface upon which the passengers and crew descend to the ground, and, in some cases, the escape slide forms a life raft for use if the aircraft is forced to land in a body of water.

During normal aircraft operation, the deflated escape slide is generally packed in a compact package or container that is mounted either on the inside of the egress door or on the floor in front of the egress door. In most applications, the upper end of the escape slide includes a girt that encompasses a girt bar which is connected to brackets mounted on the floor inside the egress door. In the event of an emergency evacuation, the door is opened and the escape slide is automatically or manually deployed through the open doorway.

One of the problems encountered with inflatable escape slides is the limited dimensions that must be exhibited by the escape slide when packed for stowage. In this respect, the escape slide stowage configuration must be small enough to be reliably deployed through the aircraft door when required. In installations wherein the escape slide is mounted to the interior of the aircraft door, the escape slide stowage configuration must not interfere with operation of the door and, for esthetic reasons, is often covered by a decorative panel that defines a specific stowage volume. In installations in which the escape slide is mounted to the floor of the aircraft, the escape slide stowage pack is generally mounted on a track arrangement or a carriage such that the packed escape slide can be swung in front of the door during aircraft flight and swung away from the door to provide access for normal aircraft entrance and exit procedures. In this case, the stowed escape slide should again occupy minimum space, since the stowage area often cannot be used for other purposes.

To form a conventional escape slide into a suitably sized and contoured stowage pack, the escape slide is generally folded in a sequence which permits reliable automatic inflation and deployment when the slide is utilized. The folded escape slide is then placed in a relatively shallow receptacle commonly called a packboard. A series of fabric panels, attached to the periphery of the packboard, is then laced together with cords so as to contain the folded escape slide between the backboard and the fabric panels. Generally, separate lacing cords are utilized along each of the four boundaries of the package or pack formed by the packboard and escape slide, i.e., the top, bottom and two sides boundaries. The packaged escape slide is then compressed to exhibit the desired contour and volume by pressing on the various surfaces of the packaged assembly and tightening the laces.

Although such a packing procedure is generally adequate, several problems arise. First, the escape slide is generally fabricated of neoprene rubber-coated fabric material that can be punctured or torn and the packaged escape slide includes other hardsurfaced apparatus that can puncture or tear the inflatable member of the escape slide if care is not exercised, both during the preliminary folding operation and the compression of the escape slide pack into its final configuration. For example, conventional escape slides normally include inflation apparatus such as one or more aspirators or turbo fans for inflating the escape slide, at least one compressed gas reservoir for driving such turbo fans, and associated hoses.

Secondly, with the advent of wide-bodied aircraft in which the doors are located a considerable distance above the ground, longer and larger escape slides have become necessary, but the space available for stowage of the escape slide has often not been increased accordingly. Thus, it has become a somewhat difficult task to form the escape slide into the required stowage configuration.

Packing an escape slide is especially difficult in a situation in which the escape slide is of the dual-purpose escape slide/life raft variety. Not only is such an escape slide/life raft generally bulkier than a standard escape slide, but a variety of survival and rescue equipment is normally included in the stowage pack. For example, to facilitate locating the life raft in a large body of water, radio beacons, locator lights and associated batteries and at least one antenna are packed along with the escape slide. To facilitate survival of the raft occupants, equipment and supplies such as hand pumps, knives, heaving lines, sea anchors and a canopy are also generally placed in the escape slide/life raft stowage pack.

Because of these problems, once the folded escape slide and accessories is placed in the packboard, as many as three or four persons are often required to form the stowage pack to the desired configuration and to tighten the lacing. Even utilizing three or four persons, great physical effort is required on the part of the slide packers. Further, because of the difficulties experienced in forcing the escape stowage pack into the desired contour, the packing personnel often resort to striking the slide pack with hard objects or jumping on or kicking the slide pack to obtain the necessary contours. Resorting to such tactics can not only damage the escape slide, but may result in personal injury to the packing personnel.

Accordingly, it is an object of this invention to provide a mechanism for assisting in the packing of an aircraft escape slide or combined escape slide/life raft.

It is another object of this invention to provide an aircraft escape slide or escape slide/life raft packing fixture that can be operated with relative ease by one or two persons.

It is yet another object of this invention to provide a packing fixture for forming the final contours of an aircraft escape slide storage pack with minimal risk of damage to the escape slide.

SUMMARY OF THE INVENTION

These and other objects are achieved in accordance with this invention by an escape slide packing fixture that is configured for receiving a partially formed escape slide stowage pack or slide and applying various mechanical forces or loads to the slide pack such that the slide pack is formed to the desired contour and volume.

In each embodiment of the invention, the partially packed escape slide is positioned on a base plate, which includes elongate brace bars mounted substantially parallel to the side surfaces of the escape slide pack. The brace bars are swingable inwardly toward the slide pack to apply a compressive force along the lower regions of each side of the slide pack. Preferably, the brace bars include jack screws that angularly extend between each brace bar and the base plate to force the brace bars inwardly against the sides of the slide pack.

To apply a distributed compressive force between the upper surface of the slide pack and the escape slide packboard, a contoured top pan is placed over the upper surface of slide pack. Straps or webs are connected between strap tighteners that are located on the base plate, opposite one another along the mutually opposed side surfaces of the slide pack. Preferably, these strap tighteners are of the ratchet type which tightens the strap as an arm or buckle is rotated. As the straps are uniformily tightened, the top pan is drawn downwardly to urge the upper surface of the slide pack toward the packboard. By tightening the slide peak lacing, the slide pack is maintained on the compressed condition.

The side and end surfaces of the slide pack are shaped to the desired contour with a forming bar that engages with the base plate and is operated in a lever-like manner. The forming bar includes a pressure pad or forming shoe that is mounted in an arm which extends angularly from the forming bar. As the free end of the forming bar is pushed toward the slide pack, a contoured surface of the forming shoe contacts a portion of an end or side surface of the slide pack and functions as the fulcrum point of a lever. Since the other end of the assist bar is engaged with the base plate, compressive force is exterted on a desired region of the slide pack. Preferably, to permit application of a compressive force to a desired region of the slide pack side and end surfaces with a desired direction of application, the arm which supports the forming shoe is positionable along the assist bar and is positionable with respect to the angle of extension therefrom.

In a typical sequence of operation, the brace bars are tightened against the slide pack and the forming bar is used forming to partially shape the sides and ends of the slide pack. As the forming bar is operated, slack is removed from the lacing that joins the slide cover panels which, in cooperation with the packboard, enclose the escape slide. The top pan is then installed over the slide pack and the straps are routed over the top pan and engaged with the strap tighteners. The strap tighteners are then alternately operated to uniformly draw the top pan downwardly toward the base pan and compress the slide pack. As slack appears in the lacing, the laces are tightened. The process continues, selectively using the forming bar to shape in the side and end surfaces and the strap tighteners to compress the slide pack upper surface toward the packboard. Generally, contour templates are utilized to determine when the slide pack is contoured to the desired shape and size.

BRIEF DESCRIPTION OF THE DRAWING

A better understanding of the present invention can be derived by reading the ensuring specification in conjunction with the accompanying drawing wherein:

FIG. 1 is an isometric view of one type of slide pack containing an inflatable aircraft escape slide or escape slide/life raft which can be shaped and formed to a necessary size and contour with the packing fixture of this invention;

FIG. 2 is an isometric view depicting the various components of the packing fixture constructed in accordance with this invention;

FIG. 4 is a side elevation view depicting the details of the brace bar and jackscrew assemblies of the embodiments of the invention depicted in FIGS. 2 and 3;

FIG. 5 is an isometric view depicting the use of the forming bar component of this invention to contour and form a side surface of the slide pack;

DETAILED DESCRIPTION

Figure 3:
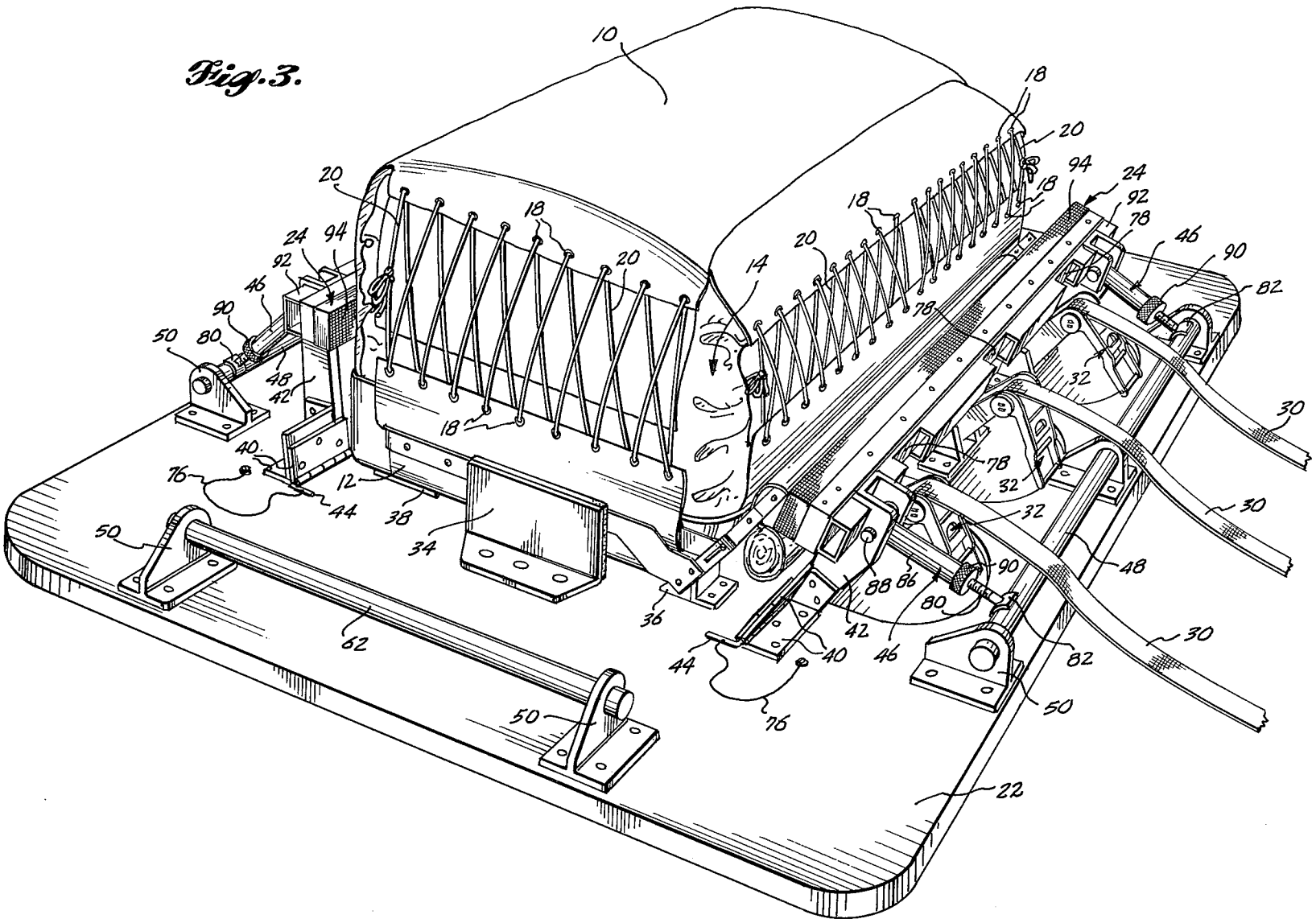
FIG. 3 is an isometric view depicting the placement of a partially packed slide pack in the packing fixture of this invention.

FIG. 1 depicts a typical slide pack which includes aircraft escape slide in the deflated condition and packed for stowage on an aircraft. As depicted in FIG. 1, the escape slide pack (generally denoted by the numeral 10), includes a packboard 12, a folded escape slide 14, and several fabric panels 16, *a, b, c* and *d* which encompass the folded escape slide 14 and retain the slide pack 10 in the desired size and shape for stowage on the aircraft. As previously mentioned the escape slide 14 can be of the variety which forms a combination escape slide/life raft. In this respect, it should be understood that, as used herein, the term "escape slide" and "slide pack" for containing an escape slide encompass both a conventionally configured escape slide and escape slide/life raft combination.

Generally, the packboard 12 is a shallow receptable formed of material such as metal or fiberglass. During the preliminary stages of packing the escape slide 14, the escape slide 14 is folded in a manner which will allow the escape slide 14 to automatically inflate when the packboard 12 is deployed outwardly through the door of an aircraft during an emergency evacuation procedure. When the esape slide 14 has been folded, the escape slide 14 is placed in the packboard 12 along with various accessories and survival equipment. For example, in escape slide embodiments that serve both as an escape slide and as a life raft, numerous items such as hand pumps, knives, throwing lines, sea anchors, radio beacons, locator lights and a life raft canopy are often placed in the escape slide pack 10. With the folded escape slide 14 and associated accessories in place, the fabric panels 16 are loosely joined together with lacing material such as nylon cord. It should be noted that the above-described procedure for partially packing the escape slide is preliminary to the use of this invention and is described in applicable manuals published by the various escape slide and aircraft manufactures. For example, with reference to a combination escape slide/-life raft identified as the type 7A1238, manufactured by the Engineered Systems Company, a division of B. F. Goodrich Co., Akron, Ohio, pertinent information is included in the B. F. Goodrich "Overhaul Manual-Escape Slide/Life Raft Assembly —747."

As can be seen in FIG. 1, the fabric panels 16 include generally rectangular fabric panels 16*a* and 16*b* which are respectively joined to the side and end surfaces of the packboard 12 such that one longitudinal edge of the fabric panels 16*a* and 16*b* is substantially parallel to and spaced apart from an associated boundary edge of the packboard 12. Each panel 16*a* and 16*b* includes a series of grommets or eyelets 18 along the outwardly located longitudinal edges which are interconnected with a like number of grommets 18 in the edge boundaries of two fabric panels 16*c* and 16*d* by lacing or cord 20. More explicitly, the front panel 16*c*, which is rectangular in shape and has a series of grommets 18 located along its minor edges, partially spans the uppr surface of the folded escape slide 14 between the two fabric panels 16*b*. In a like manner, the front panel 6*d* which is also rectangular and has a series of grommets 18 along each major edge, partially spans the upper surface of the folded escape slide 14 between the two front panels 16*b*. Lacing 20 is then threaded between the spaced apart grommets 18 of the front panels 16*c* and 16*d* and the associated grommets 18 of the fabric panel 16*a* and 16*b* in a conventional criss-cross pattern. Hithertofore, once the lacing 20 was loosely installed between the fabric panels 18, the escape slide 14 was manually compressed to the desired size and shape by pushing on various regions of the slide pack 10 and tightening the laces 20. As previously described, because the folded escape slide 14 and various accessories packed therewith are rather bulky and are constructed of materials difficult to compress without considerable force, not only are several packing personnel often required, but such personnel often resort to the use of force and blows with foreign objects that can damage the packaged escape slide or even cause personal injury.

In FIG. 2, an embodiment of this invention is depicted in a somewhat disassembled state to clearly illustrate the various components of a packing fixture constructed in accordance with this invention. As shall be described in detail, the invention includes a base plate 22, configured for receiving a partially packed escape slide, such as the slide pack 10 of FIG. 1; a pair of brace bar assemblies 24, for securing the slide pack to the base plate 22 and exerting a compressive force along the lower side regions of the slide pack; a forming bar 26 for use in conjunction with the base plate 22 for selectively compressing various regions of the side and end faces of the slide pack; and a top pan 28 which is placed on top of the slide pack and linked to the base plate 22 by belts or straps 30 for compressing the slide pack as the straps 30 are pulled downwardly by strap tighteners 32.

To receive and position a partially packed escape slide, the central region of the base plate 22 includes restraint members which are positioned to project upwardly from the upper surface of the base plate 22 in substantial contact with the side and end surfaces of a slide pack placed on the base plate 22. In the arrangement of FIG. 2, these restraints include substantially orthogonal brackets or angles 34 positioned to contact the two end surfaces and one side surface of a slide pack, and two wedge shaped blocks 36 positioned to contact a sloping edge surface of one particular type of slide pack. Generally the brackets 34 and blocks 36 are fastened to the upper surface of the base plate 22 and the faces of the brackets 34 and blocks 36 that contact the slide pack are covered or coated with a pliant material to prevent damage to the slide pack, such as scratching the packboard 12 of FIG. 1.

It will be recognized by those skilled in the art that the arrangement of restraint members, such as brackets 34 and blocks 36, is dependent on the configuration of the slide pack to be shaped and contoured within the packing fixture. In this respect, many variations are possible and the restraint configuration can often be adjustable or include various brackets and/or frame members that are removably mounted to the base plate 22 for accommodating various slide pack configurations. Further, in some situations, various other means can be alternatively or additionally utilized to insure proper registration between the slide pack and the base plate 22. For example, the arrangement of the invention depicted in FIG. 2 includes an indexing plate 38 which is shaped to nest in a recess in the outer surface of the packboard of a particular slide pack with the indexing plate 38 being mounted in an appropriate position on the base plate 22.

Each of the elongate brace bars 24, which secure a slide pack to the base plate 22 and apply a compressive force along the lower side regions of the slide pack, is attached to the base plate 22 by hinges 40 that are located at the terminus of support arms or channels 42 which extend orthoganally from each end of the brace bars 24. For storage convenience and to permit removal of the brace bars 24 for ease in positioning the slide pack on the base plate 22, the hinges 40 of the embodiment depicted in FIG. 2 are of the split-hinge type, with the two halves of each hinge 40 being joined together when the brace bars 24 are installed to the base plate 22 by removable hinge pins 44.

As shall be described in more detail relative to FIGS. 3 and 4, the brace bars 24 are forced inwardly toward the slide pack by jackscrew assemblies 46 that mount between the upper end of each brace bar support arm 42 and a side rail 48 that extends along each side of the base plate 22. Each side rail 48 is mounted to be substantially parallel with the side surfaces of a slide pack placed on the base plate 22. In the arrangement depicted in FIG. 2, the side rails 48 are circular in cross-sectional geometry and are mounted in spaced-apart relationship with the upper surface of the base plate 22 by orthogonal angle brackets 50 which are positioned at the ends and center of each side rail 48.

The side rails 48 are also utilized in conjunction with the forming bar 26 to apply compressive forces to various regions of the slide pack side surfaces. More explicitly, the forming bar 26 of FIG. 2 includes an engagement fork 52 which extends outwardly from a rod or tube 54. Additionally, a pressure shoe 56 extends outwardly from the rod 54 and is positionable along the rod for contacting a desired region of the slide pack.

As shall be described in more detail relative to FIG. 5, when the forming bar 26 is utilized to shape and contour regions of the slide pack side surfaces, the engagement fork 52 is placed on a side rail 48 with the "U"-shaped opening 58 of the engagement fork 52 partially encompassing the inner surface of the side rail 48. A pressure pad 60, located on the outer end of the pressure shoe 56, is positioned for contact with the desired region of the slide pack. The free end of the rod 54 is then pushed inwardly toward the slide pack. Since the side rail 48 constrains one end of the rod 54, the pressure shoe 56 is forced against and compresses the contacted region of the slide pack.

To provide for similar shaping and contouring of the end surfaces of the slide pack with the forming bar 26, end rails 62 are mounted to the base plate 22 in substantially parallel and spaced-apart relationship with each end surface of a slide pack that is placed in the packing fixture. The end rails 62 are similar in construction to the side rails 48, spaced-apart from the upper surface of the base plate 22 by orthogonal mounting brackets 50 located at each end of the end rails 62.

Figure 7:
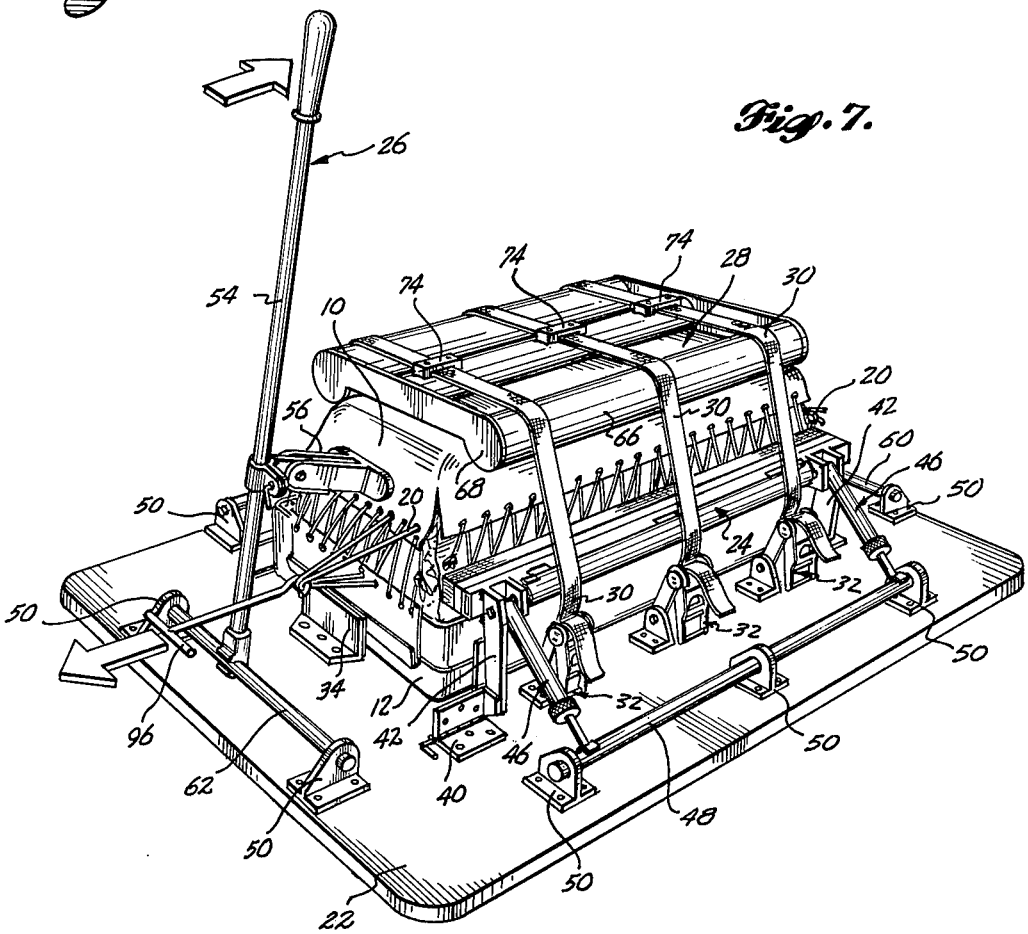
FIG. 7 is an isometric view depicting the use of a top pan component and the forming bar of FIG. 6 in shaping and contouring a slide pack in accordance with this invention.

As shall be described in more detail relative to FIG. 7, a distributed, compressive force is applied to the upper surface of the slide pack with the top pan 28, which is placed over the slide pack and interconnected with the base plate 22 by the straps 30. As can be seen in FIG. 2, the top plan 28 is of substantially rectangular assembly having a bottom surface 64 which is formed to correspond to the desired upper surface contour of the slide pack. In the particular top pan 28 that is depicted in FIG. 2, two cylindrical sections 66 form the longitudinal boundaries of the upper top pan 28, extending parallel with one another between space-apart end plates 68. A contour plate 70, joined to each tubular section 66, forms the contoured bottom surface 64 of the top plate 28, which is of generally curvature. A central brace 72 of sectorial cross-section is positioned between the two end plates 68, extending parallel to and approximately midway between the cylindrical sections 66. For convenience, strap locators 74, having rectangular slots for receiving and positioning the straps 30 project upwardly from the central brace 72.

In operation, the top pan 28 is placed on the slide pack being shaped in the packing fixture of this invention during portions of the packing procedure in which it is necessary or desirable to compress the upper surface of the slide pack downwardly, e.g., toward the packboard 12 of the slide pack 10 depicted in FIG. 1. Each strap 30 is then placed around the slide pack and top pan 28, with each end of the strap 30 being engaged with the strap tighteners 32. Each strap tightener 32 is of the type permitting the straps to be drawn downwardly by manual operation of the strap tightener. As shall be discussed relative to FIG. 8, one satisfactory type of strap tightener is commonly identified as a ratchet buckle, with one such ratchet buckle being manufactured by Ancra Corp., El Segundo Calif. and identified as part number 60-11-00-72N. In such a ratchet buckle, a buckle handle is connected to a spindle and is pivotably operable thereabout to wind a strap around the spindle as the buckle handle is swung upwardly. Ratchets, mounted to the outer end of the spindle, prevent loosening of the belt as the handle is swung downwardly in preparation for another tightening stroke.

In some embodiments of the invention, wherein the trap tighteners 32 project upwardly from the base plate 22 in a manner which would otherwise prevent the brace bars 24 from being swung outwardly over the strap tighteners 32 for ease in loading and removing a slide pack, the brace bars 24 include recesses to permit such swinging movement. In these embodiments, brace bar extensions 76 are configured for placement over the outward edge of each brace bar 24 to form a smoothly contoured surface for the straps 30. As shall be described relative to FIG. 8, each brace bar extenstion 76 is generally of semi-circular cross-section and includes tabular regions extending tangentially outward from each boundary edge. These tabular regions engage with upper and lower edges of the brace bars 24 such that the brace bar extensions 76 are snapped into place whenever needed.

Having basically described the invention, a more detailed understanding of the invention and its operation can be ascertained in view of a typical operating sequence in which the invention is utilized to shape and contour a partially packed escape slide.

With reference to FIGS. 3 and 4, the brace bars 24 are first installed to the base plate 22 by placing the two halves of the hinges 40 in alignment with one another and inserting the pins 44 through the aligned hinge sections 40. For convenience, each hinge pin 44 is normally retained to the base plate 22 by a small cable or strap 76. With the brace bars 24 interconnected with the base plate 22, the brace bars 24 are swung outwardly to permit placement of a partially packed escape slide on the base plae 22. If desired or necessary, each brace bar 24 includes recesses 78 in the rear surface thereof to permit the brace bars 24 to be swung outwardly over the strap tighteners 32. With the brace bars 24 swung outwardly, a partially packed escape slide 10 is then positioned on the base plate 22. As previously described, the base plate 22 includes restraint members such as the brackets 34 for properly positioning the partially packed escape slide 10 within the packing fixture. The brace bars 24 are then swung inwardly to contact the lower region of each side of the partially packed escape slide 10, the jackscrews 46 are then installed between each support arm 42 of the brace bars 24 and the side the side rails 48, and the jackscrews 46 are operated to force the brace bars 24 inwardly such that the brace bars 24 securely affix the partially packed escape slide 10 to the base plate 22 and partially compress the lower side regions of the partially packed escape slide 10.

With reference to FIG. 4, the jackscrew assemblies 46 each include a threaded rod 80 having an arcuately contoured foot region 82 formed at one end thereof. The threaded region of the rod 80 passes inwardly through the opening 84 of a cylindrical sleeve 86. The upper end of the cylindrical sleeve 86 passes inwardly between the spacedapart flanges of the U-shaped brace bar support arms 42 and is pivotably attached to the support arm 42 by a pin 88 that passes through the support arm flanges and the end region of the cylindrical sleeve 86. A knurled nut 90, threadedly engaged with the threaded rod 80, abuts the lower end of the cylindrical sleeve 86.

Thus, when the brace bars 24 have been attached to the base plate 22 and the jackscrews 46 have been positioned between the brace bar support arms 42 and the side rails 48 with the arcuate foot 82 partially encompassing the inner region of the side rail 48, rotating the knurled nut 90 causes the associated brace bar 24 to swing about the hinges 40. As the brace bars 24 are swung about the hinges 40, the inner surface of a substantially rectangular beam 92, which spans the region between the brace bar support arms 42, contacts the side surfaces of the partially packed escape slide 10. As can be seen in both FIGS. 3 and 4, each beam 92 can be an extrusion of rectangular cross-section which is joined to the support arms 42 by welding or other conventional fastening techniques. To minimize the possibility of damage to the slide pack 10, a pliant material 94 is attached to or coats regions of the beam 92 that contact the side surfaces of the slide pack 10. Various pliant materials 94 can be utilized, including a wide range of plastic or rubber materials and fabric material such as cut-pile carpeting.

With reference to FIG. 5, when the slide pack 10 has been placed on the base plate 22 and securely retained in the proper position by the brace bars 24, it is generally advantageous to utilize the forming bar 26 to partially shape and contour the side and end surfaces of the slide pack 10. Such forming is accomplished, in accordance with this invention, by progressively positioning the forming bar 26 along the side and end rails 48 and 62, forcing the free end of the forming bar 26 inwardly toward the slide pack 10 and tightening the slide pack laces 20.

More explicity, as shown in FIG. 5, the U-shaped opening 58 of the forming bar engagement fork 52 is placed over the innr surface region of the side rail 48 or end rail 62, adjacent to a portion of the side or end surface of the slide pack 10 that is to be shaped. The pressure shoe 56 is then positioned against the desired region of the slide pack 10 with the pressure pad or forming surface 60 in contact with the slide pack and the free end of the forming bar 26 is pushed inwardly to cause the pressure pad 60 of the forming bar 26 to press against the contacted region of the slide pack. As regions of the slide pack side and end surface are compressed, the slide pack lacing 20 is drawn tighter by pulling on the lacing with a packing hook 96 or other conventional tool. By progressively moving the forming bar 26 along the side rail 48 and end rails 62, the lacing 20 can be tightened to draw the slide pack fabric panels 16 toward one another and maintain the slide pack in a partially compressed and shaped condition.

Figure 6A:
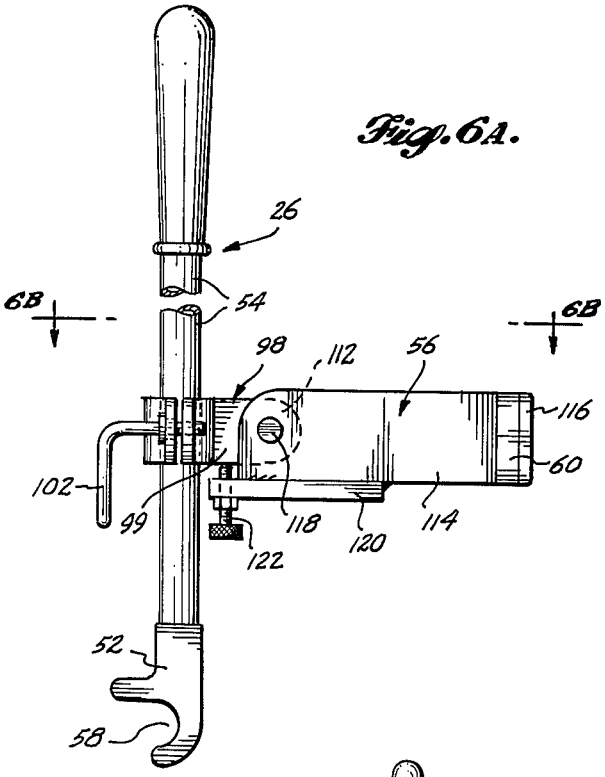
FIGS. 6*a* and 6*b* respectively depict a side view and an end view of the forming bar depicted in FIG. 5.
Figure 6B:
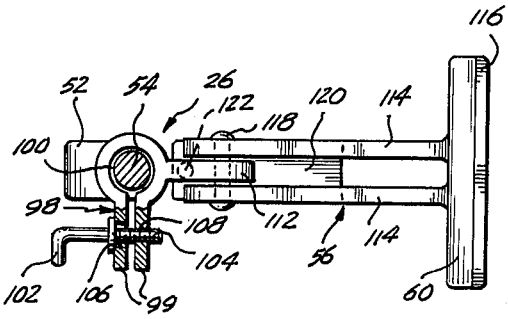

Preferably, the forming bar pressure shoe 56 is positionable along the length of the forming bar rod 54 and positionable with respect to the angle with which the pressure shoe 56 projects from the rod 54 to permit the pressure shoe 56 to be set at a position which will contact a desired region of the side and end surfaces of the slide pack 10. More explicitly, referring to the forming bar embodiment of FIGS. 6*a* and 6*b*, the pressure shoe 56 is attached to the rod 54 by a clamp ring 98. The clamp ring 98 is a metal strap that is formed to encompass the rod 54 with two end regions of the strap forming flanges 99 that project radially outward from the rod 54. A substantially circular opening 100 is formed in the closed portion of the clamp ring 98 such that the opening 100 will be compressed about the rod 54 to lock the clamp ring 98 to the rod 54 as the outwardly extending flanges 99 of the clamp ring 98 are pressed together. A locking key 102, having a threaded end region 104, passes through a clearance opening 106 in one of the clamp ring flanges 99 and engages with an internally threaded opening 108 in the other clamp ring flange 99. The locking key 102 includes an outwardly extending annular region 112 which abuts the flange 99 that contains the clearance opening 106 and compresses the clamp ring flanges to lock the clamp ring 98 to the rod 54 as the locking key 102 is turned.

The pressure shoe 56 extends angularly from the clamp ring 98 being mounted to a radially extending flange 112 which projects orthogonally from the outer surface of the clamp ring 98 in substantial alignment with the axial center line of the rod 54. More explicitly, the pressure shoe 56 includes a mounting arm formed by two spaced-apart flanges 114 that extend orthogonally outward from a substantially rectangular plate that forms the pressure pad 60. As in the case of other elements which contact the surface of the slide pack 10, the surface of the pressure pad 60 is preferably coated or covered with a pliant material 116. In any case, the flange 112 of the clamp ring 98 is positioned between the spaced-apart flanges 114 of the pressure shoe 56 and is pivotably mounted thereto by a pin 118 which passes through both pressure shoe flanges 114 and the clamp ring flange 112.

To permit angularly positioning the pressure shoe 56 relative to the rod 54, a plate 120 is fastened between the pressure shoe flanges 114 at a position below the clamp ring flange 112. The plate 120 projects inwardly toward the rod 54 and beyond the end terminus of each pressure shoe flange 114. An adjusting screw 122 passes through a threaded opening in the plate 120 such that the end of the adjusting screw 122 abuts the lower surface of the clamp ring flange 112. By rotating the adjusting screw 122, the pressure shoe 56 can be rotated about the pin 118 such that the pressure pad 60 will contact a desired region of the slide pack side and end surfaces as the forming bar 26 is used (FIG. 5). If desired or necessary, the pin 18 can be a conventional fastener such as a bolt to frictionally control the pivoting movement of the pressure shoe 56 about the clamp ring 98, or to securely lock the pressure shoe 56 in a desired position.

With reference to FIG. 7, once any desired preliminary contouring and shaping of the side and end surfaces of the slide pack 10 is achieved, the primary shaping and contouring operation is effected by use of the top pan 28 in conjunction with the forming bar 26. In this respect the top pan 28 is placed on top of the partially formed slide pack 10 and the straps 30 are engaged with the strap tighteners 32, which are spaced apart along the oppositely disposed side surfaces of the slide pack 10, with the straps 30 encompassing top pan 28 and passing through the strap locators 74.

Figure 8:
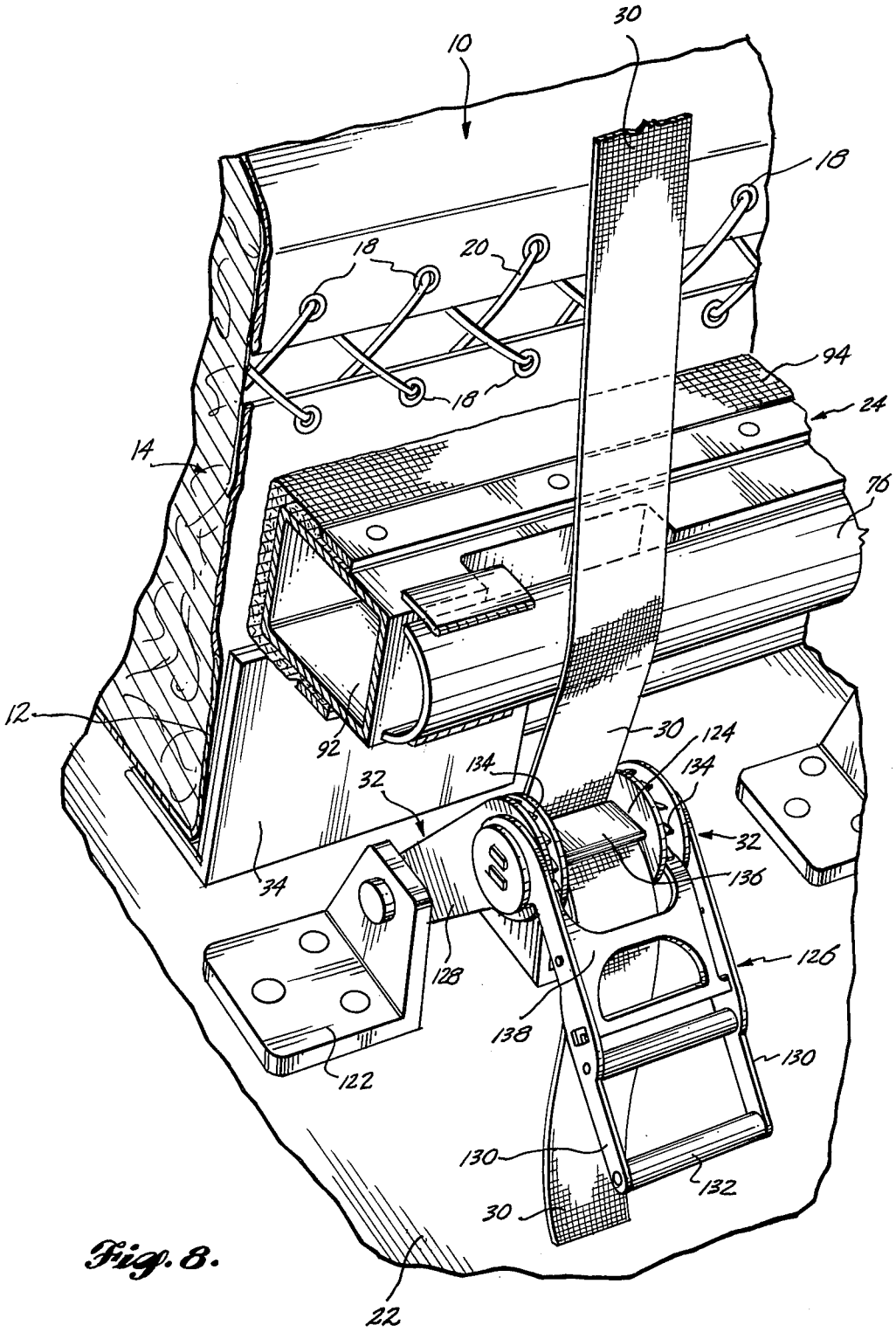
FIG. 8 is an isometric view depicting strap tighteners that are utilized in conjunction with the top pan component of the invention for compressing the slide pack into its desired shape and size.

As previously indicated, each strap tightener 32 is a conventional device that facilitates drawing the straps 30 downwardly toward the base plate 22 to compress the slide pack 10 with the top pan 28. As depicted in FIG. 8 such devices can be attached to the upper surface of base plate 22 by angular mounting brackets 122 and other conventional techniques. The strap tightener 32 depicted in FIG. 8 is of the variety commonly referred to as a ratchet buckle which winds the strap 30 onto a drum-like spindle 124 as a buckle handle 126 is swung in the upward direction. In this arrangement, two parallel, spaced-apart plates 128 are pivotably mounted to the mounting brackets 122 with the spindle 124 being rotatably mounted between the upper end regions of the plates 128. The buckle handle 126 includes two spaced-apart plates 130 with a tubular grip 132 interconnecting the lower end of the plates 130. The upper end of the plates 130 pass outwardly of the plates 128 for interconnection with the spindle 124. In particular, the buckle handle plates 130 drive the spindle 124 through a conventional ratchet arrangement 134 that is mounted between the ends of the spindle 124 and the inner surface of the plates 128.

In operation, a strap 30 is inserted through a groove formed between the spindle 124 and an arcuate strap retainer 136 coaxially spaced-apart from the surface of the spindle 124. The ratchet arrangement 134 is configured such that the strap 30 is wound on the spindle 124 as the ratchet handle 126 is swung upwardly with the ratchet 134 locking the spindle 124 against reverse rotation each time the buckle handle is swung through a particular angle. Since the ratchet arrangement 134 is configured such that the buckle handle 126 can be swung downwardly without releasing the spindle 124, the strap tighteners 132 can be utilized to apply a distributed, compressive force to the upper surface of the slide pack 10 by alternately swinging the buckle handles 126 of each strap tightener 32 upwardly and downwardly. To release the strap tighteners, the end of detent plate 138 is pushed downwardly, while the buckle handle 126 is moved upwardly through a small angle. The detent plate 138 then disengages the ratchet assemblies 134, allowing the spindle 124 to rotate and release the straps 30.

Regardless of the exact configuration of the strap tighteners 32 the slide pack 10 is progressively shaped and contoured to the desired dimensions by progressively tightening the straps 30 to compress the upper surface of the slide pack toward the rear surface, e.g., the packboard 12 (FIG. 7). As the straps 30 are tightened, the slide pack laces 20 are tightened by means of the packing hook 96 or other conventional hand tool. In addition, as the top pan 28 is utilized to compress the slide pack 10, the forming bar 26 is utilized to shape and contour the slide pack end and side surfaces as was described relative to FIG. 5.

In the above described manner, the operator of the packing apparatus continues to selectively utilize the forming bar 26 and the top pan 28 until the slide pack 10 reaches the desired dimensions and contour. In this respect, it is often advantageous to utilize contour templates which can be placed over predetermined regions of the slide pack to ascertain when the slide pack is within desired dimensional limits. In most cases, the packing apparatus operator will be able to visually observe that the slide pack is within or very close to the desired configuration nd then remove the top pan 28 so that such contour templates can be utilized. If the desired shape and contour have not been achieved, the operator can utilize the forming bar 26 to impart the final form to the slide pack 10, and, if necessary, reinstall the top pan 28 for further compression of the slide pack 10. Once the slide pack has been shaped to the desired size and contour, the top pan 28 is removed and the brace bars 24 are released and swung outwardly so that the slide pack can be removed from the base plate 22.

It will be recognized by those skilled in the art that the embodiment of the invention described herein is exemplary in nature and that many variations are possible without exceeding the scope and spirit of the invention. For example, although the depicted embodiment utilizes three straps 30, in some situations two straps may suffice. Further, although the straps 30 are depicted as separate components of the depicted embodiment, such straps can be permanently affixed to the top pan 28. Additionally, in some embodiments of the invention the side rails 48 and end rails 62 can be replaced by grooves or tracks in the base plate 22 with the jack screw assemblies 46 and forming bar 26 being configured for engagement in the grooves or tracks.

The embodiments of the invention in which an exclusive property or privilege is claimed are defined as follows:

1. Packing apparatus for shaping and contouring a compressible item, wherein said compressible item is retained in a compressed state by compression members which encircle at least a portion of said compressible item, said compression members being configured for maintaining said compressible item in a final configuration of desired size and shape, having an upper surface, a lower surface, a first and second side surface and first and second end surfaces, each of said surfaces being of a generally predetermined contour, said packing apparatus comprising:

a base plate assembly including means for receiving and retaining a partially shaped and contoured compressible item in a fixed orientation relative to said base plate assembly, said lower surface of said compressible item contacting said base plate assembly;

first compression means engageable with said base plate assembly and positionable for compressing selected regions of said first and second end surfaces and said first and second side surfaces of said compressible item; and, second compression means positionable on said upper surface of said compressible item, said second compression means including interconnection means for interconnecting said second compression means with said base plate assembly, said interconnection means being operable for drawing said second compression means toward said base plate assembly to urge said upper surface of said compressible item inwardly toward said bottom surface of said compressible item.

2. The packing apparatus of claim 1 wherein said first compression means comprises an elongate forming bar having a forming shoe projecting angularly therefrom, said forming shoe including a forming surface for contacting a selected region of said first and second side surfaces and said first and second end surfaces of said compressible item, one end of said forming bar including means for engaging said forming bar with said base plate assembly at selected positions along said first and second side surfaces and said first and second end surfaces, said forming surface of said forming shoe being positionable on a selected region of said first and second side surfaces and said first and second end surfaces when said forming bar is engaged with said base plate assembly, said forming surface being forced inwardly to compress said selected region when the free end of said forming bar is swung inwardly toward said compressible item.

3. The packing apparatus of claim 2 wherein said base plate assembly includes first and second side rails and first and second end rails, said first and second end rails being mounted and spaced apart from said upper surface of said base plate assembly with said first and second side rails respectively being substantially parallel with said first and second end surfaces of said compressible item, said first and second side rails being mounted to and spaced apart from said upper surface of said base plate assembly with said first and second side rails respectively being substantially parallel to said first and second side surfaces of said compressible item; and, wherein said means for engaging said forming bar with said base plate assembly includes an engagement fork angularly disposed relative to said elongated forming bar, said engagement fork being positionable along said first and second side rails and first and second end rails to partially encompass said rails.

4. The packing apparatus of claim 2 wherein said forming shoe includes means for positioning said forming shoe along at least a portion of the length of said elongate forming bar.

5. The packing apparatus of claim 4 wherein said forming shoe further includes means for angularly positioning said forming shoe relative to said elongate forming bar.

6. The packing apparatus of claim 1 wherein said second compression means includes a top pan of a size and geometry commensurate with said upper surface of said compressible item, said top pan having a surface contoured to substantially correspond to the desired final contour of said upper surface of said compressible item, and a plurality of straps for encompassing said top pan and said compressible item when said top pan is placed on said upper surface of said compressible item; and, wherein said base plate assembly includes a plurality of strap tighteners, each of said strap tighteners being mounted to said upper surface of said base plate assembly for receiving said straps, each of said tighteners being operable to engage with one of said straps and draw said top pan downwardly for compressing said upper surface of said compressible item towards said lower surface of said compressible item.

7. Packing apparatus for forming and shaping a slide pack containing an aircraft emergency slide, said slide pack having panels interconnected with one another by lacing, said lacing being drawn together to maintain said slide pack in the desired final shape and contour, having an upper surface, a lower surface, first and second side surfaces and first and second end surfaces, said packing apparatus comprising:

a base plate having an upper surface, including means for receiving and retaining a partially formed slide pack with said lower surface of said slide pack being positioned on said upper surface of said base plate;

a forming bar including a rod and a forming shoe, said rod having a first end including means for engaging said forming bar with said base plate, said forming shoe being mounted to said rod and extending angularly therefrom, said forming shoe including a forming surface for contouring regions of said slide pack side and end surfaces;

first engagement means included on said upper surface of said base plate for engagement by said forming bar, said first engagement means being disposed in spacedapart juxtaposition with said side surfaces and said end surfaces of said partially formed slide pack that is received and retained on said upper surface of said base plate, said first end of said forming bar rod being engageable with said first engagement means at a selected location along said side and end surfaces of said partially formed slide pack to place said forming surface of said forming shoe in contact with a selected region of said side and end surfaces of said slide pack for compressing said contacted region as the second end of said forming bar rod is swung arcuately about said engagement means and inwardly toward said slide pack;

a compression member positionable on said upper surface of said slide pack for urging said upper surface of said slide pack downwardly toward said lower surface of said slide pack, said compression member including a contoured surface commensurate in geometry with said upper surface of said slide pack, said contoured surface having a contour substantially corresponding to said desired final contour of said slide pack upper surface;

interconnection means for interconnecting said compression member with said base plate, said interconnection means extending downwardly toward said base plate when said compression member is positioned on said upper surface of said slide pack; and second engagement means for engaging with said interconnection means, said second engagement means mounted to said upper surface of said base plate and being operable to draw said compression member downwardly toward said base to urge said upper surface of said slide pack downwardly toward said lower surface of said slide pack.

8. The packing apparatus of claim 7 wherein said first engagement means includes first and second end rails and first and second side rails, said first and second end rails being respectively mounted to extend in spaced-apart relationship with said first and second end surfaces of said slide pack ang being mounted in spaced-apart relationship with said upper surface of said base plate, said first and second side rails being respectively mounted to extend in spaced-apart relationship with said first and second side surfaces of said slide pack and being mounted in spaced-apart relationship with said upper surface of said base plate; and, wherein said first end of said forming rod includes a U-shaped recess for partially encircling one of said side rails and said end rails at said selected location along said side and end surfaces of said slide pack.

9. The packing apparatus of claim 8 wherein said means for receiving and containing said partially formed slide pack includes first and second brace bar means, each of said first and second brace bar means including a beam member and at least two support members, said support members being connected to said beam members to extend angularly therefrom, said support members being pivotably connected to said upper surface of said base plate assembly, said first and second brace bars swingable about said pivotable connections to force said brace bar beam members against the lower portion of said first and second side surfaces of said slide pack.

10. The packing apparatus of claim 9 further comprising at least one jackscrew means angularly extendable between each of said first and second brace bar means and one of said first and second side rails for forcing said beam members of said first and second brace bars means against said lower portions of said first and second side 11. The packing apparatus of claim 7 wherein said forming bar includes means for slidably mounting said forming shoe to said rod for selectively positioning said forming shoe axially along said rod, said forming bar further including means for angulary positioning said forming shoe relative to said rod.

12. The packing apparatus of claim 7 wherein said interconnection means for interconnecting said compression member with said base plate includes at least two straps positionable to encircle said compression member and said slide pack; and, wherein said second engagement means comprises a plurality of strap tighteners positioned in spaced-apart relationship with one another along said upper surface of said base plate, said strap tighteners including means for receiving said straps and drawing said straps downwardly for urging said upper surface of said slide pack toward said lower surface of said slide pack.

13. A packing fixture for forming and shaping a partially formed aircraft escape slide stowage pack of the type wherein an inflatable aircraft emergency escape slide assembly is folded and placed in a packboard having fabric panels extending from the boundary surfaces thereof, said fabric panels being interconnected with fabric cover panels by laces to encompass said folded escape slide between said fabric panels and said packboard, said laces being tightenable to maintain said escape slide stowage pack in a predetermined volume and shape having an upper surface, first and second side surfaces, and first and second end surfaces, said packing fixture comprising:

a baseplate including means for receiving said packboard of said escape slide stowage pack to position said escape slide stowage pack in a predetermined orientation relative to said baseplate, said baseplate having a side rail extending in spaced apart relationship with each of said side surfaces of a partially formed escape slid stowage pack placed in said receiving means, said base plate also having an end rail extending in spaced apart relationship with each of said end surfaces of said partially formed stowage packed placed in said receiving means, said baseplate further having a plurality of spaced apart strap tighteners positioned in spaced apart relationship with one another along said first and second side surfaces of said stowage pack placed in said baseplate receiving means;

first and second brace bars mountable to said base plate for swinging against the lower portions of said first and second stowage pack side surfaces for retaining said stowage pack to said baseplate, each of said brace bars including a beam member having a surface for contacting said lower portion of said stowage pack side surfaces and first and second support arms extending angularly outward from said beam member, said support arms pivotably attachable to said baseplate;

a forming bar for engaging with each of said side rails and end rails for compressing and contouring a selected region of said storage pack side and end surfaces, said forming bar including an elongate rod having a forming shoe slidably connected thereto, said forming shoe extending angularly from said rod and having a contouring surface on the outwardly disposed terminal region thereof, said rod including an engagement fork extending angularly from one end of said rod for partially encompassing one of said side rails and end rails with said contouring surface of said forming shoe in contact with said selected region of said stowage pack and end side surface, said rod being swingable about said engagement fork for compressing said selected region of said stowage pack and end side surfaces with said contouring surface of said forming shoe; and compression means for urging said upper surface of said storage pack downwardly toward said packboard, said compression means including a top pan having a contoured bottom surface that is positioned over said upper surface of said stowage pack, said compression means including a plurality of straps for linking said top pan with said strap tighteners, each of said being engageable with an associated one of said strap tightenersm said strap tighteners being operable for drawing said top pan downwardly toward said baseplate to urge said storage pack upper surface toward said packboard.

14. The packing apparatus of claim 13 wherein said forming bar further includes means for selectively adjusting the angle at which said forming shoe extends from said rod of said forming bar.

15. The packing apparatus of claim 13 wherein said plurality of straps comprise three straps, each of said straps connectable between two of said strap tighteners mounted opposite one another along said first and second side surfaces of said stowage pack with said strap encircling said stowage pack and said top pan.

* * * * *

UNITED STATES PATENT OFFICE

CERTIFICATE OF CORRECTION

Patent No. 4,104,964 Dated August 8, 1978

Inventor(s) Peter J. Larkworthy et al.

It is certified that error appears in the above-identified patent and that said Letters Patent are hereby corrected as shown below:

Column 3, line 24, "peak" should be —pack—.

Column 3, line 67, "ensuring" should be —ensuing—.

Column 4, line 52, "esape" should be —escape—.

Column 4, line 66, "manufactures" should be —manufacturers—.

Column 5, line 18, "uppr" should be —upper—.

Column 7, line 23, "space-apart" should be —spaced-apart—.

Column 8, line 31, delete "the side", first occurrence.

Column 8, line 43, "spacedapart" should be —spaced-apart—.

Column 9, line 14, "explicity" should be —explicitly—.

Column 9, line 16, "innr" should be —inner—.

Column 11, line 34, "nd" should be —and—.

Column 13, line 15, before "tighten-" insert —strap—.

UNITED STATES PATENT OFFICE

CERTIFICATE OF CORRECTION

Patent No. 4,104,964 Dated August 8, 1978

Inventor(s) Peter J. Larkworthy et al.

It is certified that error appears in the above-identified patent and that said Letters Patent are hereby corrected as shown below:

Column 13, line 22, insert —compliant— after "having".

Column 13, line 43, "spacedapart" should be —spaced-apart—.

Column 14, line 16, "ang" should be —and—.

Column 14, line 45, insert —surfaces of said slide pack—after "side".

Column 16, line 24, "tightenersm" should be —tighteners,—.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*